US009335712B2

(12) United States Patent
Yoshida et al.

(10) Patent No.: US 9,335,712 B2
(45) Date of Patent: May 10, 2016

(54) METHOD FOR MEASURING LUBRICANT-INDUCED SURFACE ROUGHNESS AND IMAGE FORMING APPARATUS

(71) Applicant: Konica Minolta, Inc., Chiyoda-ku (JP)

(72) Inventors: Tomohisa Yoshida, Toyokawa (JP); Tsugihito Yoshiyama, Toyohashi (JP); Yoshiki Nakane, Toyokawa (JP); Yohei Ito, Toyokawa (JP); Masanori Kawada, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/223,940

(22) Filed: Mar. 24, 2014

(65) Prior Publication Data

US 2014/0286653 A1 Sep. 25, 2014

(30) Foreign Application Priority Data

Mar. 25, 2013 (JP) ..... 2013-061427

(51) Int. Cl.
*G03G 15/00* (2006.01)
*G03G 21/00* (2006.01)

(52) U.S. Cl.
CPC ..... *G03G 21/0094* (2013.01)

(58) Field of Classification Search
CPC ..... G03G 21/0094
USPC ..... 399/26, 346
See application file for complete search history.

(56) References Cited

U.S. PATENT DOCUMENTS

| | | | | |
|---|---|---|---|---|
| 2007/0059067 | A1 | 3/2007 | Tanaka et al. | |
| 2008/0220355 | A1 * | 9/2008 | Kamoi et al. | 430/66 |
| 2011/0229202 | A1 * | 9/2011 | Mizumoto et al. | 399/130 |

FOREIGN PATENT DOCUMENTS

| | | | |
|---|---|---|---|
| JP | 2007-139808 | A | 6/2007 |
| JP | 2008-224828 | A | 9/2008 |

* cited by examiner

*Primary Examiner* — Billy Lactaoen
(74) *Attorney, Agent, or Firm* — Buchanan Ingersoll & Rooney PC

(57) ABSTRACT

A method applicable to an image forming apparatus with a lubricant to be applied to a surface of a photoreceptor for measuring surface roughness of the surface of the photoreceptor after lubricant application, the method including: a first step of measuring a surface profile of the photoreceptor and obtaining first data indicating the surface profile; a second step of generating second data on the basis of the first data, the second data indicating arithmetic mean roughness Ra within a predetermined range; and a third step of calculating a difference value ΔRa between second data before lubricant application and second data after lubricant application obtained by performing the first and second steps both before and after the lubricant is applied to the photoreceptor.

9 Claims, 9 Drawing Sheets

FIG. 7

| VARIABLE NO. | ΔRa [nm] | INCORPORATION AMOUNT [wt%] | FRICTION COEFFICIENT | IMAGE QUALITY | CLEANABILITY | APPLICATION AMOUNT [mg/m$^2$] | CHARGE POTENTIAL [V] | Vo-Vbr [V] | APPLICATION BRUSH | ABUTTING DIRECTION |
|---|---|---|---|---|---|---|---|---|---|---|
| 1 | 0.3 | 0.19 | 0.28 | O | O | 25 | -600 | 0 | A | COUNTER |
| 2 | 1.3 | 0.33 | 0.22 | O | O | 19 | -600 | -300 | A | COUNTER |
| 3 | 8.8 | 0.55 | 0.25 | Δ | O | 26 | -600 | -300 | B | COUNTER |
| 4 | 15.4 | 0.68 | 0.26 | x | O | 35 | -600 | 0 | B | COUNTER |
| 5 | 6.4 | 0.50 | 0.27 | Δ | O | 22 | -600 | 300 | B | COUNTER |
| 6 | 5.2 | 0.42 | 0.28 | Δ | O | 30 | -300 | 0 | A | COUNTER |
| 7 | 0.4 | 0.05 | 0.37 | Δ | x | 5 | -600 | -300 | B | COUNTER |
| 8 | 1.4 | 0.03 | 0.51 | Δ | x | 1 | -600 | -300 | B | COUNTER |
| 9 | 2.5 | 0.06 | 0.33 | O | Δ | 12 | -600 | -300 | B | COUNTER |
| 10 | 11.0 | 0.97 | 0.29 | x | O | 28 | -600 | -600 | B | COUNTER |
| 11 | 18.1 | 1.07 | 0.23 | x | O | 18 | -600 | -300 | B | TRAILING |
| 12 | 19.9 | 0.86 | 0.27 | x | O | 35 | 0 | 0 | B | COUNTER |
| 13 | 43.0 | 1.03 | 0.27 | x | O | 40 | -600 | 0 | B | COUNTER |
| 14 | 47.1 | 1.13 | 0.25 | x | O | 44 | -600 | 0 | B | COUNTER |

METHOD FOR MEASURING LUBRICANT-INDUCED SURFACE ROUGHNESS AND IMAGE FORMING APPARATUS

This application is based on Japanese Patent Application No. 2013-061427 filed on Mar. 25, 2013, the content of which is incorporated herein by reference.

BACKGROUND OF THE INVENTION

1. Field of the Invention

The present invention relates to a method for measuring surface roughness of a lubricant applied to a photoreceptor drum, and an image forming apparatus employing the measurement results.

2. Description of Related Art

In an electrographic image forming apparatus, a toner image is formed on the surface of a photoreceptor. The toner image is transferred from the surface of the photoreceptor onto a transfer target such as an intermediate transfer belt. Moreover, the image forming apparatus includes a cleaning blade to remove toner remaining on the surface of the photoreceptor after transfer.

Furthermore, to reduce abrasion or suchlike of the photoreceptor, an application brush and a solid lubricant (referred to below as a lubricant) are provided immediately downstream from the cleaning blade in the rotational direction of the photoreceptor. The application brush is disposed so as to be able to contact the surface of the photoreceptor. Moreover, the lubricant is pressed against the application brush by a biasing unit. With this configuration, the lubricant is scraped by rotating the application brush, and thereafter, the scraped lubricant is supplied to the surface of the photoreceptor. As a result, a lubricant film is formed on the surface of the photoreceptor (see, for example, Japanese Patent Laid-Open Publication Nos. 2007-139808 and 2008-224828).

Incidentally, the surface of the photoreceptor coated with the lubricant film is subjected to charging and exposing steps so that an electrostatic latent image is formed thereon. Thereafter, a developing device rotates a developing roller provided therein, which is in contact with the surface of the photoreceptor. As a result, a developer is supplied to the surface of the photoreceptor, so that a toner image is formed. At this time, the lubricant on the surface of the photoreceptor might be scraped in part and incorporated into the developer contained in the developing device. In particular, lubricant particles remaining without becoming films adhere to the surface of the lubricant film, and the adhesion of these lubricant particles to the surface of the lubricant film is so weak that they are separated from the surface of the photoreceptor merely by contacting the supplied developer. Therefore, the lubricant particles are readily incorporated into the developer in the developing device through contact with the developer or the developing roller.

Such lubricant incorporation results in a reduced amount of charge in the developer. As a result, the image forming apparatus is susceptible to powder smoke generated therein, hence occurrence of an uneven image density, i.e., reduced image quality.

SUMMARY OF THE INVENTION

A first embodiment of the present invention is directed to a method applicable to an image forming apparatus with a lubricant to be applied to a surface of a photoreceptor for measuring surface roughness of the surface of the photoreceptor after lubricant application, the method including: a first step of measuring a surface profile of the photoreceptor and obtaining first data indicating the surface profile; a second step of generating second data on the basis of the first data, the second data indicating arithmetic mean roughness Ra within a predetermined range; and a third step of calculating a difference value ΔRa between second data before lubricant application and second data after lubricant application obtained by performing the first and second steps both before and after the lubricant is applied to the photoreceptor.

A second embodiment of the present invention is directed to an image forming apparatus for which a condition for lubricant application to a photoreceptor is set on the basis of a difference value ΔRa obtained by the above method. In this case, the difference value ΔRa preferably satisfies the relationship $\Delta Ra<10$ nm.

BRIEF DESCRIPTION OF THE DRAWINGS

FIG. 7 is a table listing a difference value ΔRa, an incorporation amount, a friction coefficient, image quality, and cleanability for each variable;

DETAILED DESCRIPTION OF THE PREFERRED EMBODIMENTS

Figure 1:
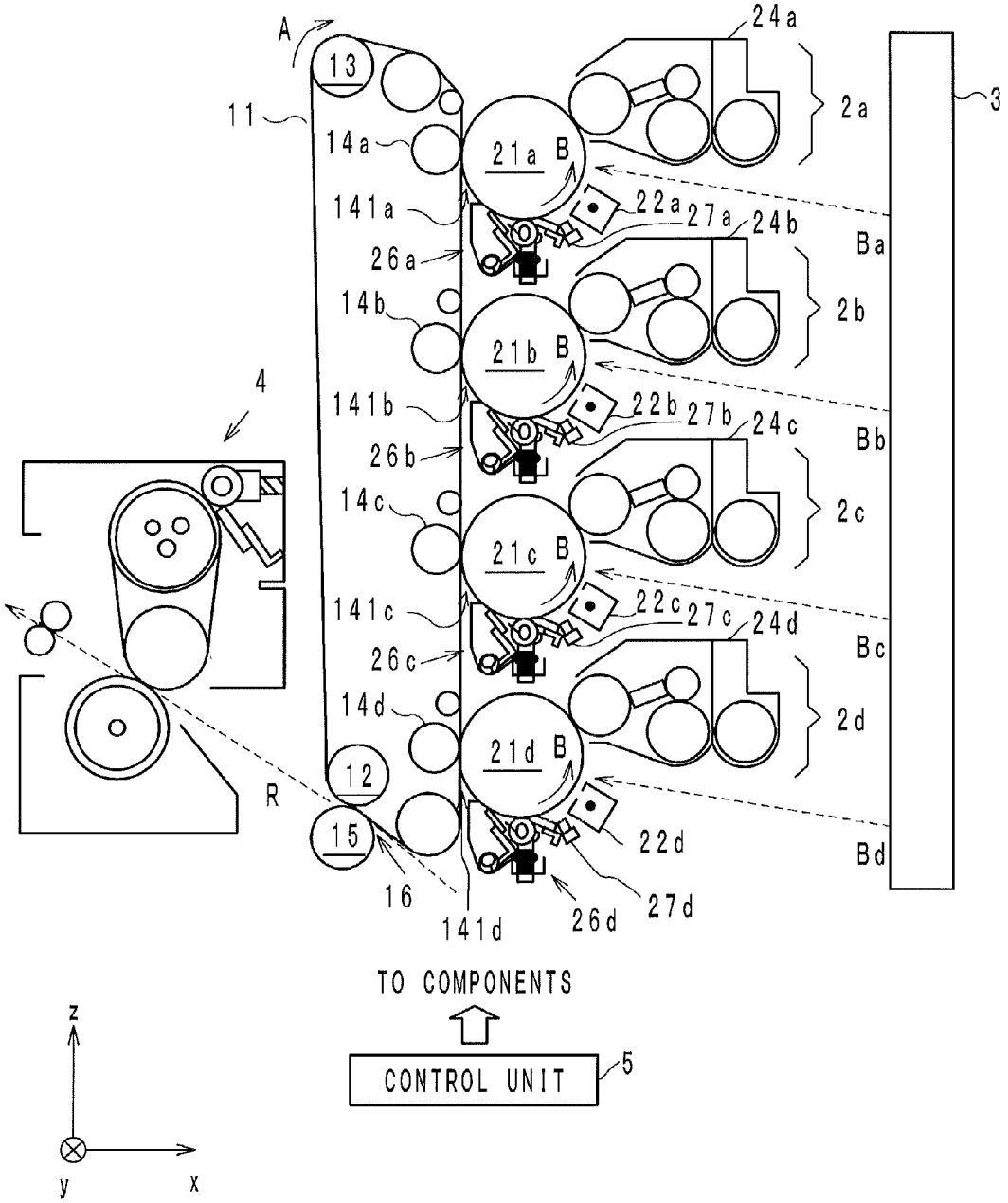
FIG. 1 is a diagram illustrating essential parts of an image forming apparatus according to an embodiment of the present invention.

First, an image forming apparatus to which a lubricant application amount measurement method according to an embodiment of the present invention is applied will be described below. In some figures, the X-, Y-, and Z-axes represent the right-left (horizontal), front-rear (depth) and top-bottom (height) directions, respectively, of the image forming apparatus. The lower-case alphabet letters a, b, c, and d suffixed to reference numerals are affixes that denote yellow (Y), magenta (M), cyan (C), and black (Bk). For example, a photoreceptor drum 21*a* is intended to mean a photoreceptor drum 21 for yellow.

Configurations of Essential Parts of Image Forming Apparatus

In FIG. 1, the image forming apparatus is, for example, an electrographic, tandem, full-color multifunction peripheral (MFP). The image forming apparatus includes an intermediate transfer belt 11. The intermediate transfer belt 11 is put on peripheries of a roller 12, a tension roller 13, etc., and is driven to rotate clockwise as indicated by arrow A.

Imaging units 2*a*, 2*b*, 2*c*, and 2*d* are arranged in this order, from top to bottom, to the right of the intermediate transfer belt 11. The imaging units include photoreceptor drums 21 for their corresponding colors. The photoreceptor drums 21 are in the form of cylinders extending in the depth direction, and rotate, for example, counterclockwise about their own central axes, as indicated by arrow B. Arranged around the photoreceptor drums 21*a* to 21*d* are, in order along their rotational directions B, charging devices 22*a* to 22*d*, developing devices 24*a* to 24*d*, cleaning devices 26*a* to 26*d*, and diselectrifying units 27*a* to 27*d*.

Furthermore, primary transfer rollers 14*a* to 14*d* are provided so as to be opposed to the photoreceptor drums 21*a* to 21*d* with respect to the intermediate transfer belt 11. Primary transfer areas 141*a* to 141*d* are created between the primary transfer rollers 14*a* to 14*d* and the intermediate transfer belt 11. In addition, a secondary transfer roller 15 is disposed so as to be opposed to the roller 12 with respect to the intermediate transfer belt 11 and tightly contact the intermediate transfer belt 11. A nip is created between the secondary transfer roller 15 and the intermediate transfer belt 11 as a secondary transfer area 16.

Furthermore, an exposing unit 3 is provided to the right of the imaging units 2*a* to 2*d*.

Furthermore, disposed below the main unit of the image forming apparatus is a sheet cassette in which sheet materials are placed, although the cassette is not shown in the figure. A feed roller provided in the sheet cassette forwards the sheet materials one by one to a transportation path R indicated by a dotted arrow. Provided in the transportation path R are a timing roller pair, the secondary transfer area 16, and a fusing device 4, which are omitted in the figure.

Furthermore, the main unit of the image forming apparatus includes a control unit 5. The control unit 5 includes, for example, a microcomputer, nonvolatile memory, and main memory. The microcomputer executes a program stored in the nonvolatile memory, in the main memory, thereby controlling the aforementioned components.

General Operation of Image Forming Apparatus

Next, the general operation of the image forming apparatus will be described. In the image forming apparatus, the charging devices 22 charge the photoreceptor drums 21 for their corresponding colors, uniformly across their surfaces (charging step). The exposing unit 3 irradiates the charged surfaces of the photoreceptor drums 21 with optical beams B for the corresponding colors, thereby forming electrostatic latent images in the colors (exposing step). The developing devices 24 supply toner to the photoreceptor drums 21 that support the electrostatic latent images in the colors, thereby forming toner images in the colors on the surfaces of the photoreceptor drums 21 (developing step). Next, the toner images supported on the photoreceptor drums 21 are sequentially transferred to the same area on the intermediate transfer belt 11, in the primary transfer areas 141 for their corresponding colors, thereby forming a full-color composite toner image on the intermediate transfer belt 11 (primary transfer). The composite toner image is supported on the intermediate transfer belt 11 and transported to the secondary transfer area 16.

Here, toner that is left untransferred onto the intermediate transfer belt 11 remains on the surfaces of the photoreceptor drums 21 as untransferred toner. The untransferred toner is transported toward a cleaning device 26 for its corresponding color through rotation of the photoreceptor drum 21. The cleaning device 26 is provided around the photoreceptor drum 21 for the corresponding color, so as to be positioned downstream in the rotational direction B relative to the primary transfer area 141 for the color. The cleaning device 26 recovers untransferred toner by scraping it from the photoreceptor drum 21 for the color (cleaning step). The recovered toner is transported from the cleaning device 26 for the color to an unillustrated waste toner box, and collected in the waste toner box.

Furthermore, any traces of the electrostatic latent images that remain on the surfaces of the photoreceptor drums 21*a* to 21*d* are erased through whole image exposure by the diselectrifying unit 27*a* to 27*d*. Here, each diselectrifying unit 27 is an array of luminous elements extending in the depth direction between the cleaning device 26 and the charging device 22 in the rotational direction B. The diselectrifying unit 27 illuminates the surface of the photoreceptor drum 21 such that the current image history (memory image) does not remain for the next image formation.

Furthermore, a sheet material fed from the sheet cassette is transported in the transportation path R until it contacts the timing roller pair (not shown) at rest. Thereafter, the timing roller pair starts rotating in synchronization with transfer timing in the secondary transfer area 16, thereby feeding the sheet material at temporary rest to the secondary transfer area 16.

In the secondary transfer area 16, the composite toner image on the intermediate transfer belt 11 is transferred to the sheet material introduced from the timing roller pair by the roller 12 and the secondary transfer roller 15 (secondary transfer). The sheet material subjected to secondary transfer is fed further downstream in the transportation path R by the secondary transfer roller 15 and the intermediate transfer belt 11.

The fusing device 4 includes a fusing roller and a pressure roller. The sheet material fed from the secondary transfer area 16 is introduced to a nip created by these rollers. The fusing roller heats the toner image on the sheet material passing through the nip, and simultaneously, the pressure roller presses the sheet material. As a result, a full-color toner image is fixed on the sheet material. Thereafter, the fusing roller and the pressure roller forward the sheet material subjected to the fusing process, further downstream in the transportation path R. The forwarded sheet material is ejected into an output tray after passing through an unillustrated ejection roller.

Configuration of Cleaning Device

Figure 2A:
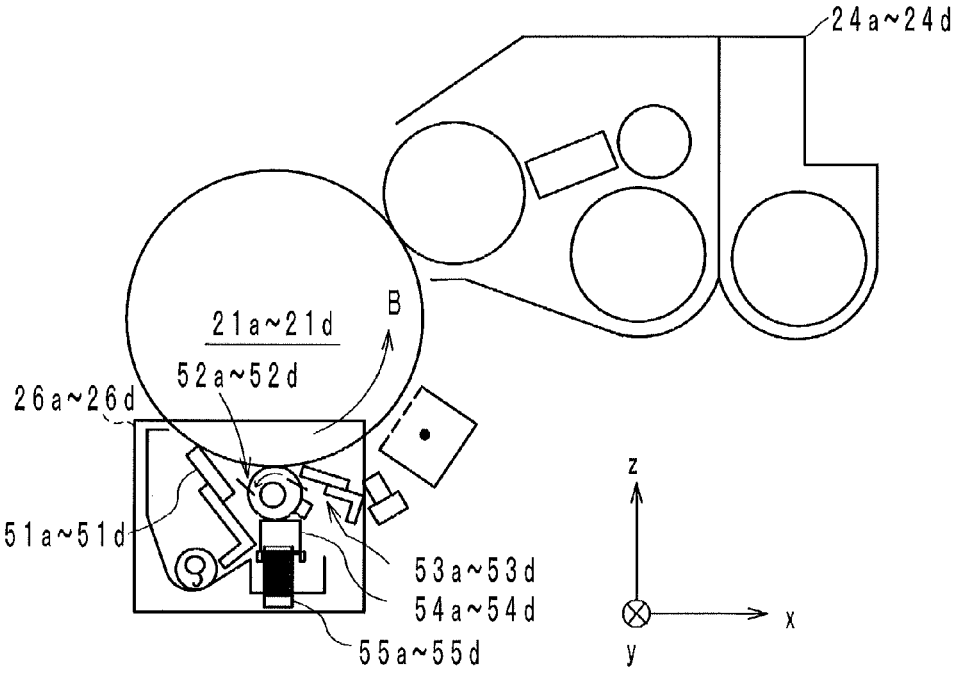
FIG. 2A is a diagram illustrating in detail the configuration of a cleaning device in FIG. 1.

Next, the configuration of the cleaning devices 26 will be described in detail. The cleaning devices 26 have the same configuration, and each unit includes a cleaning blade 51, an application unit 52, a leveling unit 53, a solid lubricant 54, and a biasing unit 55, as shown in FIG. 2A. Here, the cleaning blade 51, the application unit 52, and the leveling unit 53 are arranged in this order, from upstream to downstream in the rotational direction B of the photoreceptor drum 21.

The cleaning blade 51 is made of polyurethane rubber processed into a sheet-like form by a centrifugal molding machine. The cleaning blade 51 is bonded to a retaining plate by a hot-melt adhesive so as to extend in the depth direction. The cleaning blade 51 is pressed against the photoreceptor drum 21, thereby scraping untransferred toner adhering to the rotating photoreceptor drum 21.

Figure 2B:
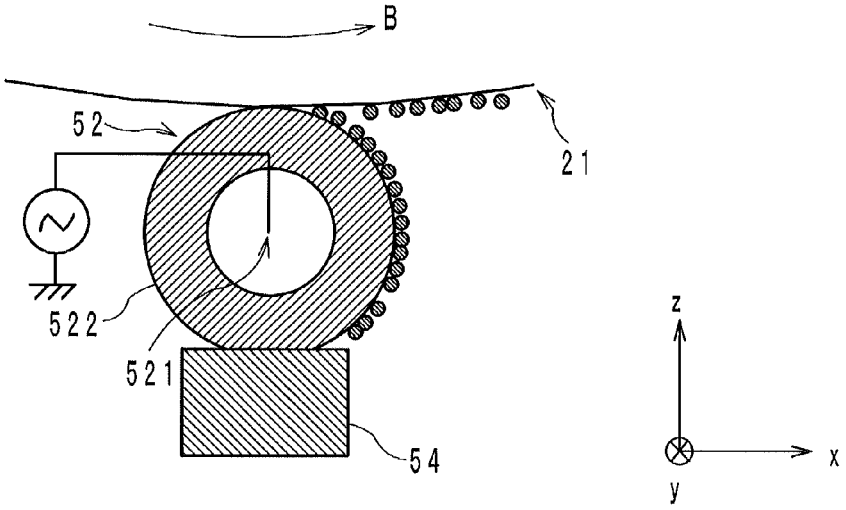
FIG. 2B is a diagram illustrating in detail the configuration of an application unit in FIG. 2A.

The application unit 52 extends in the depth direction, and at least includes a metal shaft 521 and an application brush 522, as explicitly shown in FIG. 2B. The application brush 522 is provided in the form of a roll woven into a ground cloth held on the shaft 521. In addition, the application brush 522 rotates about the shaft 521 in the same direction as the photoreceptor drum 21 (i.e., a counter direction) at a higher linear velocity (e.g., a 1.3 times higher linear velocity) than the photoreceptor drum 21. The application unit 52 thus configured is disposed such that the application brush 522 contacts the surface of the photoreceptor drum 21.

Here, example specifications of the application unit 52 will be described in detail. The material of the application brush 522 is conductive acrylic, and the fiber resistance thereof is about $10^6\Omega$. The application brush 522 has a fiber thickness of 3 T (decitex) and a fiber density of 225 kF/inch$^2$. Moreover, the shaft 521 is made of iron and has a diameter of 6 mm. Furthermore, the application brush 522 has an outer diameter of 12 mm, but the fiber length thereof is about 2.5 mm because it is woven on the ground cloth whose thickness is about 0.5 mm.

FIG. 2B will be referenced again. The solid lubricant 54 is provided below the application unit 52. The solid lubricant 54 is biased upward by the biasing unit 55, which is, for example, a spring, and pressed against the application brush 522 of the application unit 52. More specifically, the solid lubricant 54 is shaped by melting zinc stearate powder, and bonded to a retention member composed of a plate via a double-side tape because it is brittle and readily broken without reinforcement.

Furthermore, as with the cleaning blade 51, the leveling unit 53 is polyurethane rubber produced in the form of a plate by a centrifugal molding machine, and fixed to a retaining plate via a hot-melt adhesive, and the leveling unit 53 is angled against rotation of the photoreceptor drum 21.

Operation of Cleaning Device

Next, the operation of the cleaning device 26 as configured above will be described in detail. The application unit 52 rotates about the shaft 521 in the same rotational direction as the rotational direction B at a higher linear velocity than the photoreceptor drum 21*a* (e.g., at a linear velocity ratio of 1.3 times). The solid lubricant 54 is scraped by rotation of the application unit 52 and biasing force of the biasing unit 55, and therefore returns to powder form. This powder will be referred to below as lubricant particles. The lubricant particles adhere to the application brush 522, and are supplied to the surface of the photoreceptor drum 21 through rotation of the application unit 52.

The lubricant particles adhering to the surface of the photoreceptor drum 21 are transported to the leveling unit 53 through rotation of the drum 21. The leveling unit 53 takes advantage of the thrust on the surface of the photoreceptor drum 21 to form a lubricant film. Here, in the case where the solid lubricant 54 is zinc stearate, the formed lubricant film is characterized by having high mold releasability and a low friction coefficient. Such characteristics result in enhanced cleanability and can inhibit friction of the photoreceptor drum 21. Thus, the service lives of the photoreceptor drum 21 and the cleaning blade 51 can be extended.

However, not all of the lubricant particles supplied to the surface of the photoreceptor drum 21 are formed into a film, and some lubricant particles adhere to the surface of the lubricant film. Most such particles have sizes of up to about several micrometers. Moreover, the lubricant particles have very weak adhesion, and for example, when an electrostatic latent image on the photoreceptor drum 21 is developed by toner, some lubricant particles are separated from the lubricant film through friction with a developer, and incorporated into the developer contained in the developing device 24. As a result, the quantity of charge in the toner might be reduced, leading to reduced image quality. On the other hand, decreasing the amount of lubricant applied to the surface of the photoreceptor drum 21 in order to reduce lubricant incorporation results in decreased cleanability.

The present inventors repeated experimentation and found out at first that surface roughness of the photoreceptor drum 21 induced by a lubricant applied to the surface of the photoreceptor drum 21, rather than the amount of lubricant applied onto the surface of the photoreceptor drum 21, is correlated with image quality (i.e., the amount of lubricant incorporation into the developing device 24). To define such lubricant-induced surface roughness, the inventors initially defined pre-application surface roughness Ra1 and post-application surface roughness Ra2, the pre-application surface roughness Ra1 being arithmetic mean roughness Ra for the surface of the photoreceptor drum 21 free of lubricant, and the post-application surface roughness Ra2 being arithmetic mean roughness Ra for the surface of the photoreceptor drum 21 with a sufficient amount of lubricant applied under a condition out of contact with a developer. In addition, the inventors defined a difference value ΔRa to indicate lubricant-induced surface roughness, the value being obtained by subtracting the pre-application surface roughness Ra1 from the post-application surface roughness Ra2. The method for measuring the difference value ΔRa will be described below.

Lubricant-induced Surface Roughness Measurement Method

Figure 3:
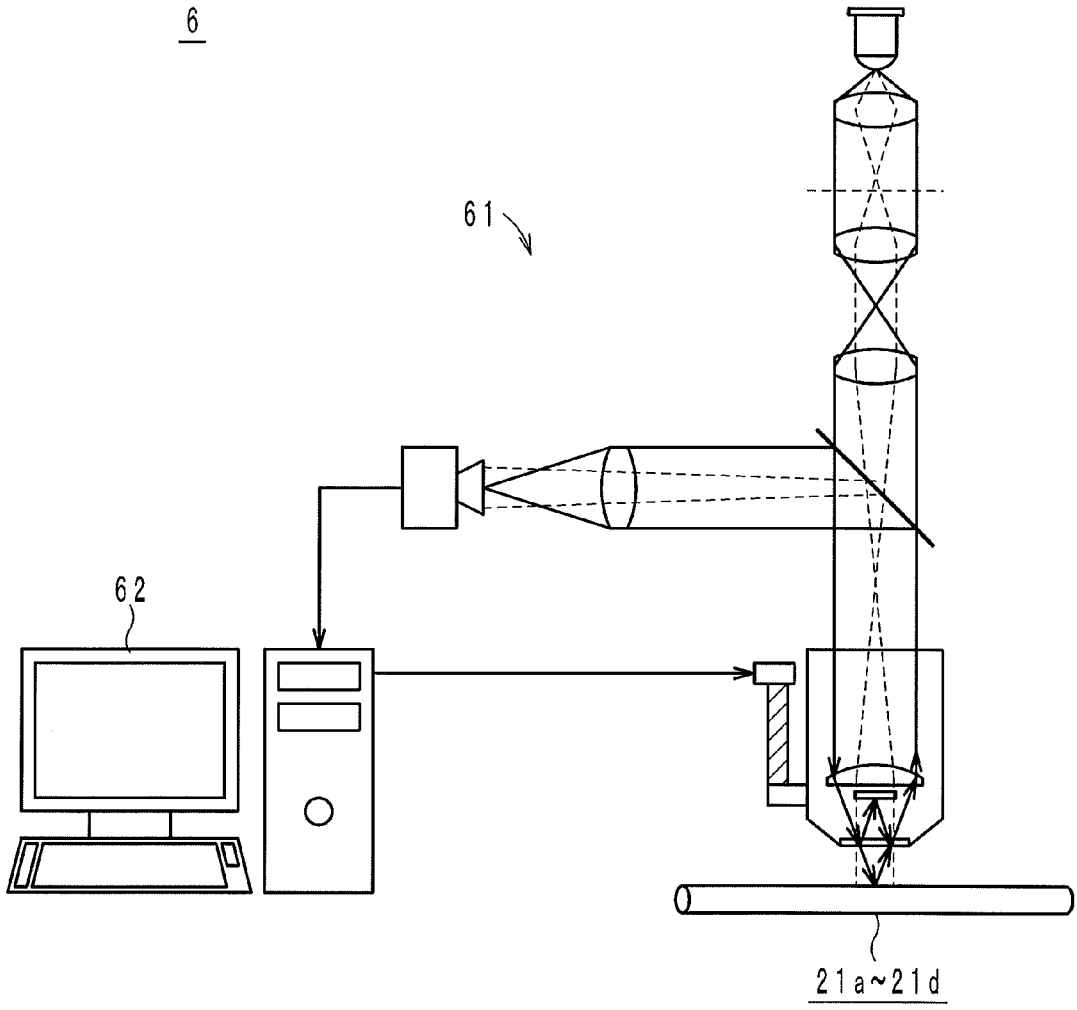
FIG. 3 is a diagram illustrating a system for measuring lubricant-induced surface roughness.
Figure 4:
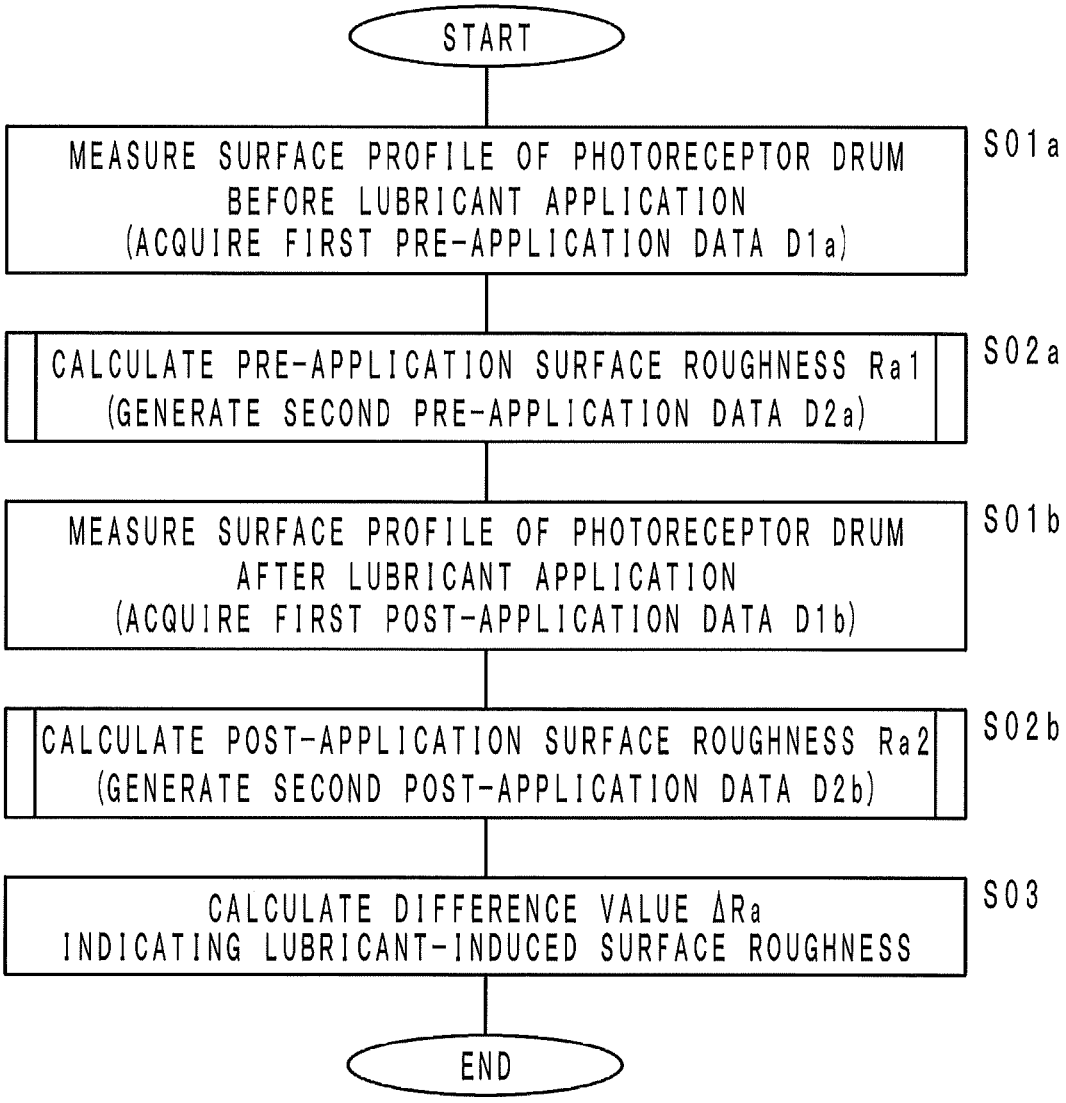
FIG. 4 is a flowchart illustrating process steps by the measurement system in FIG. 3.

FIG. 3 is a diagram illustrating a measurement system for measuring a surface's profile. In FIG. 3, the measurement system 6 includes an optical surface roughness profiler 61, which is, for example, a Mirau interferometer, and a computer 62 for control analysis. The operation of the measurement system 6 will be described below with reference to FIGS. 4 to 6.

The profiler 61 is, for example, a "Wyko NT9100" optical profiler manufactured by Veeco Instruments Inc. The profiler 61 is required to have a resolution of from several to tens of nanometers [nm], which is smaller than the lubricant particle size by one to two orders of magnitude. To measure pre-application surface roughness Ra1, a photoreceptor drum 21 is set in the profiler 61 before lubricant application or after lubricant removal from the surface of the drum by a method to be described later or suchlike. The profiler 61 measures the surface profile of the photoreceptor drum 21, and generates first pre-application data D1a, which indicates the surface profile (step S01*a*).

Figure 5:
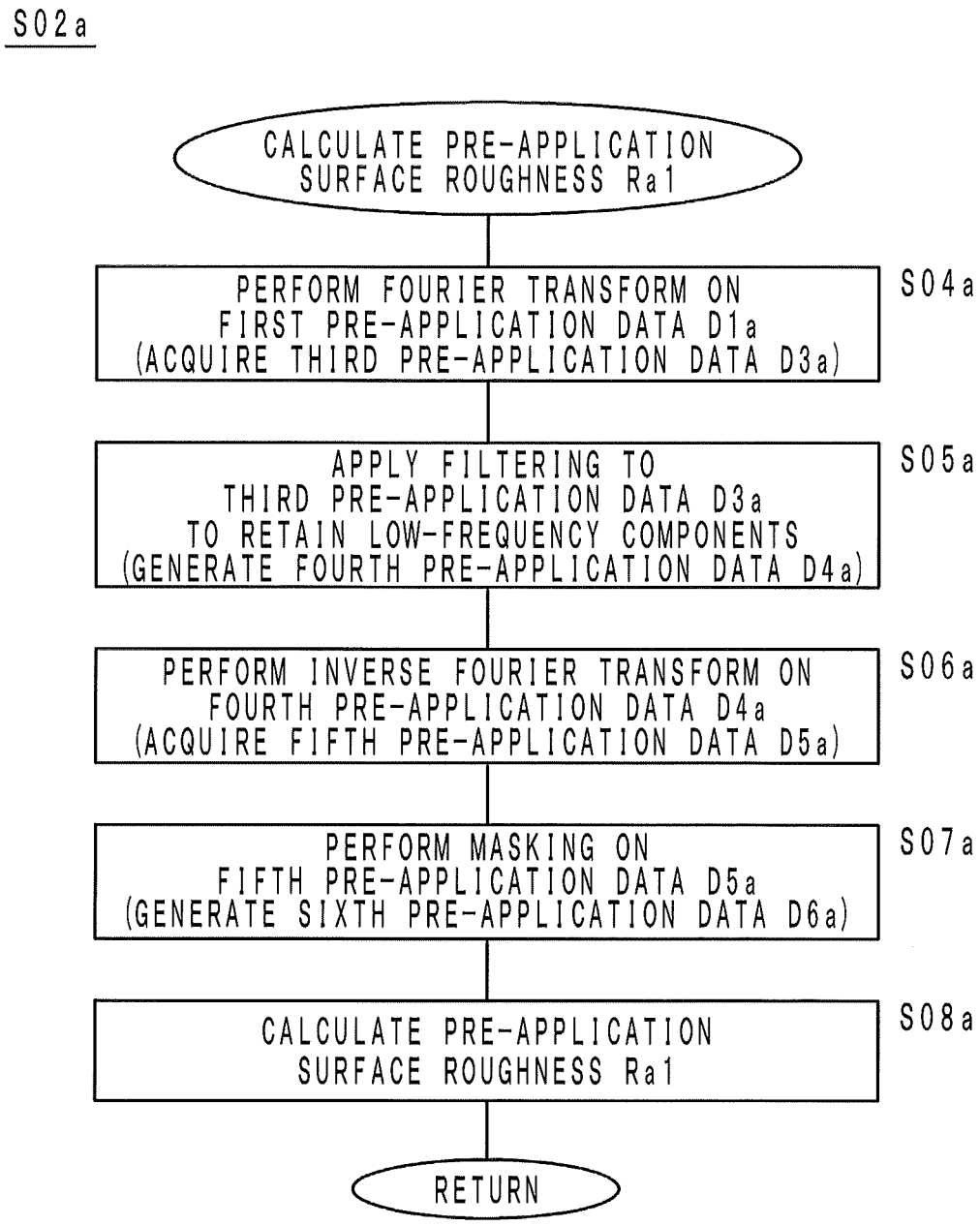
FIG. 5 is a flowchart illustrating the details of step S02*a* in FIG. 4.

Next, the computer 62 calculates pre-application surface roughness Ra1 on the basis of the first pre-application data D1a obtained in step S01*a* (step S02*a*). Step S02*a* includes steps S04*a* to S08*a*, as shown in FIG. 5. The computer 62 initially performs two-dimensional Fourier transform on the first pre-application data D1a, thereby acquiring third pre-application data D3a (step S04*a*). The third pre-application data D3a represents the surface profile of the photoreceptor drum 21 before lubricant application on a wavelength axis.

Next, the computer 62 applies Gaussian filtering to the third pre-application data D3a obtained in step S04*a*, thereby removing wavelength components greater than or equal to a predetermined wavelength (e.g., 30 mm) from the third pre-application data D3a. As a result, the computer 62 obtains fourth pre-application data D4a (step S05*a*). Here, predetermined wavelength components are removed for the following reasons. Specifically, the photoreceptor drum 21 includes an aluminum base and layers formed above the aluminum base, such as a charge generating layer and a charge transporting layer. Here, the aluminum base is completed by cutting an original pipe. By the cutting, grooves with a wavelength of about 30 mm are provided in the surface of the aluminum base. Step S05*a* is performed in order to remove such wavelength components not induced by the lubricant.

Next, the computer 62 performs inverse Fourier transform on the fourth pre-application data D4a obtained in step S05*a*, thereby generating fifth pre-application data D5a, which represents the surface profile of the photoreceptor drum 21 free of the predetermined wavelength components (step S06*a*).

Next, the computer 62 performs masking on the fifth pre-application data D5a obtained in step S06*a*, thereby generating sixth pre-application data D6a, which represents the surface profile of a central portion in the fifth pre-application data D5a (step S07*a*).

Here, the central portion will be described in detail. The first pre-application data D1a generated by the profiler 61 represents the profile of a predetermined area (e.g., a rectangular area of 0.5 mm×0.4 mm) on the surface of the photoreceptor drum 21 with a two-dimensional interference figure. The same can be said of the fifth pre-application data D5a processed by the two-dimensional Fourier transform and the filtering. However, in the fifth pre-application data D5a, irregularities of the peripheral profile around the predetermined area become greater than those of the central portion because of edge effect. Therefore, the masking in step S07*a* is performed to remove, for example, 5% of the peripheral portions at the four sides of the rectangular area, thereby generating the sixth pre-application data D6a representing the surface profile for the central portion of the predetermined area.

Next, the computer 62 calculates arithmetic mean roughness using the sixth pre-application data D6a obtained in step S07*a*, thereby acquiring pre-application surface roughness Ra1 (step S08*a*).

The definition of the arithmetic mean roughness herein will now be described thoroughly along with the details of the processing in step S08*a*. The computer 62 calculates a reference plane relative to the surface profile represented by the sixth pre-application data D6a. Next, the computer 62 integrates absolute values relative to the reference plane for all vertical components included in the sixth pre-application data D6a. Thereafter, the computer 62 divides the resultant value by the area of the reference plane, thereby obtaining pre-application surface roughness Ra1 as arithmetic mean roughness. Note that Japanese Industrial Standard (JIS) B0601 defines arithmetic mean roughness Ra for two-dimensional data, but the pre-application surface roughness Ra1 to be used as arithmetic mean roughness is three-dimensional data to which JIS B0601 is applied.

By the above process, roughness components for the aluminum base of the photoreceptor drum 21 are removed from the pre-application surface roughness Ra1. Moreover, because of edge effect, irregularities of the peripheral portions become greater after two-dimensional Fourier transform and filtering when compared to the central portion. Therefore, masking is performed such that pre-application surface roughness Ra1 is obtained using only the data for the central portion. In this manner, by the process of FIG. 5, pre-application surface roughness Ra1 can be obtained with high accuracy.

Next, to measure post-application surface roughness Ra2, a photoreceptor drum 21 with a sufficient amount of lubricant applied to the surface under a condition out of contact with a developer is set in the profiler 61. The profiler 61 measures the surface profile of the photoreceptor drum 21, thereby generating first post-application data D1b, which represents the surface profile of the photoreceptor drum 21 (step S01*b*).

Figure 6:
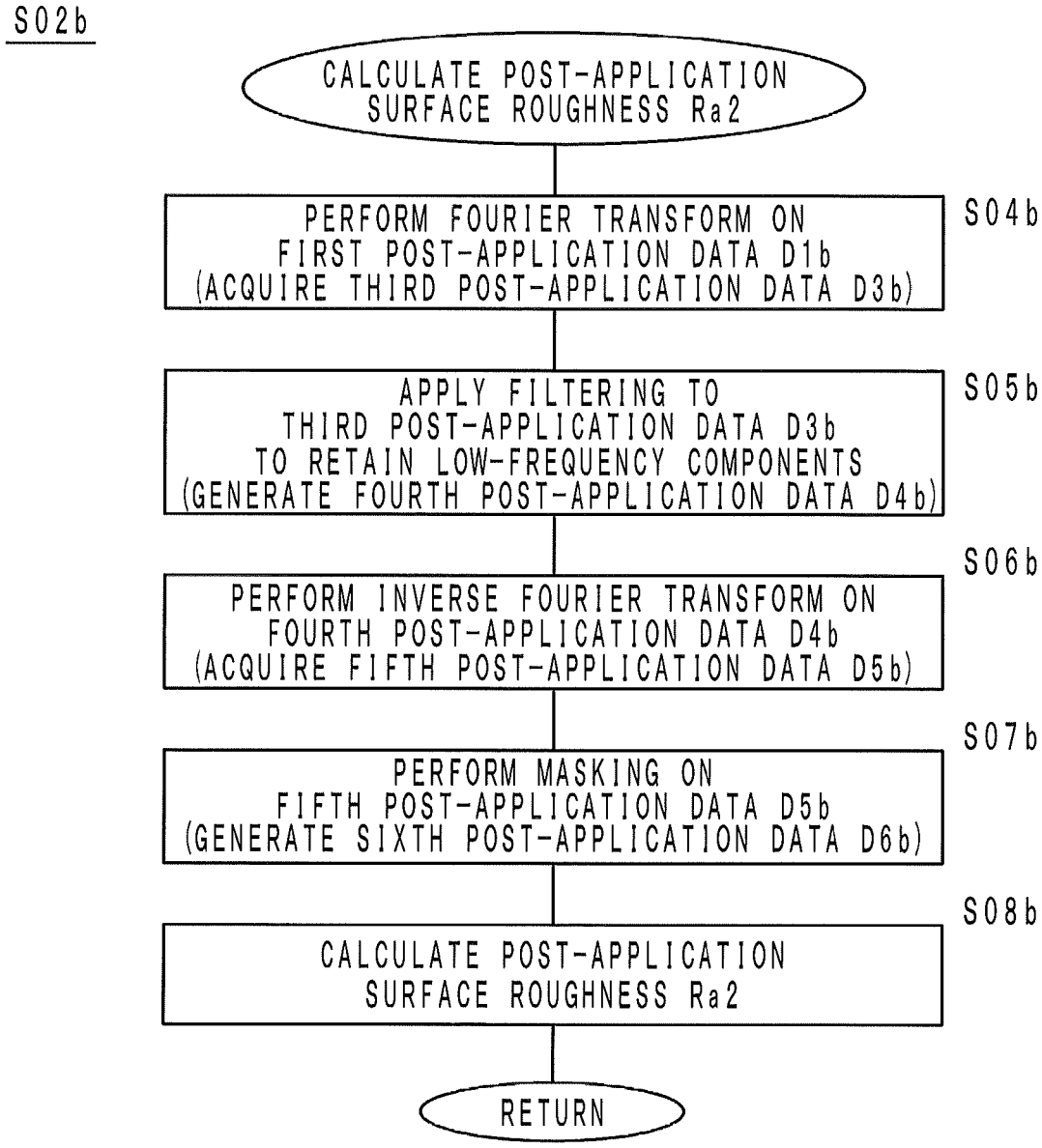
FIG. 6 is a flowchart illustrating the details of step S02*b* in FIG. 4.

Next, the computer 62 calculates post-application surface roughness Ra2 on the basis of the first post-application data D1b obtained in step S01*b* (step S02*b*). Step S02*b* includes steps S04*b* to S08*b*, as shown in FIG. 6. Steps S04*b* to S08*b* differ from steps S04*a* to S08*a* in that post-application data, rather than pre-application data, is processed. There are no other differences between them, and therefore, any detailed descriptions of steps S04*b* to S08*b* will be omitted.

Next, the computer 62 calculates a difference value ΔRa, which is a value indicating lubricant-induced surface roughness and obtained by subtracts the pre-application surface roughness Ra1 from the post-application surface roughness Ra2 (step S03).

Effects

Next, the inventors carried out experimentation as below to confirm the correlation between image quality (the amount of lubricant incorporation into the developing device 24) and the difference value ΔRa.

First, the experimental environment for evaluating image quality was as follows:

Equipment used: bizhub PRESS C8000 manufactured by Konica Minolta Inc.

Print speed: 80 pages/minute (A4, horizontal)

Temperature: 23° C.

Humidity: 65% RH

Lubricant: Zinc stearate

Printed image: Character image at 5% image coverage

Details of print: Intermittent printing of six pages was repeated until the number of revolutions of the photoreceptor drum 21 reached 400,000.

Ratio of the circumferential speed of the application unit to the circumferential speed of the photoreceptor drum (circumferential speed ratio): 0.7

Next, image quality evaluations were carried out in the above environment, along with confirmation of the difference value ΔRa and the amount of lubricant incorporation into a developer while changing combinations of the following parameters, as shown in FIG. 7: lubricant application amount; surface potential Vo of photoreceptor drum 21; difference between surface potential Vo of photoreceptor drum 21 and bias voltage Vbr applied to application unit 52 (Vo−Vbr); type of application unit 52 (straight bristle brush A or roll brush B); and abutting direction of leveling unit 53 against photoreceptor drum 21 (counter or trailing direction).

The difference value ΔRa is obtained by the procedure as described earlier. Here, to obtain pre-application surface roughness Ra1, the lubricant needs to be removed from the surface of the photoreceptor drum 21. To stop lubricant application, the application unit 52 and the biasing unit 55 are sufficiently distanced from the surface of the photoreceptor drum 21. In this state where no lubricant is applied to the photoreceptor, the developing device 24 supplies toner to the surface of the photoreceptor drum 21, and the photoreceptor drum 21 is rotated sufficiently for the toner to be supplied to the cleaning blade 51. The cleaning blade 51 uses the toner as an abrasive to abrade the lubricant applied to the surface of the photoreceptor drum 21. To remove the lubricant completely, the abrading is performed with toner supplied in an amount equivalent for 200 pages of half-tone images. Steps S01*a* and S02*a* are performed on the photoreceptor drum 21 in such a state.

Furthermore, to obtain post-application surface roughness Ra2, the cleaning device 26 and the application unit 52 are required to be in contact with the surface of the photoreceptor drum 21. Therefore, the developing device 24 and the intermediate transfer belt 11 are sufficiently distanced from the surface of the photoreceptor drum 21. In this state, the cleaning device 26 supplies a predetermined amount of lubricant as shown in FIG. 7 to the surface of the photoreceptor drum 21, and the photoreceptor drum 21 is rotated sufficiently. Steps S01*b* and S02*b* are performed on the photoreceptor drum 21 in such a state.

Furthermore, the amount of lubricant incorporation into the developer is obtained in the following manner. Specifically, the present inventors executed printing, for example, under the aforementioned experimental conditions using the photoreceptor drum 21 with a lubricant applied in a predetermined amount as shown in FIG. 7. Thereafter, the inventors used a fluorescent X-ray measurement device to analyze components in the developer originally contained in the developing device 24 and the lubricant incorporated into the developing device 24, and obtained the mass ratio of the lubricant to the developer as the amount of lubricant incorporation.

Furthermore, the friction coefficient of the surface of the photoreceptor drum 21 is measured by a well-known technique in compliance with, for example, JIS K 7125.

Furthermore, the inventors evaluated two types of image noise. The first image noise is caused by the quantity of charge in toner being reduced due to lubricant incorporation into the developer in the developing device 24 (i.e., image fogging). The second image noise is caused by abrasion of the cleaning blade 51 (i.e., defective cleaning).

The inventors visually confirmed both image fogging and defective cleaning. In the "image quality" column in FIG. 7, crosses are assigned to variables confirmed to have caused image fogging, triangles are assigned to variables confirmed to have caused slight image fogging, and circles are assigned to variables confirmed to have caused no image fogging. As for defective cleaning, crosses, triangles, and circles are similarly assigned in the "cleanability" column in FIG. 7.

Figure 8:
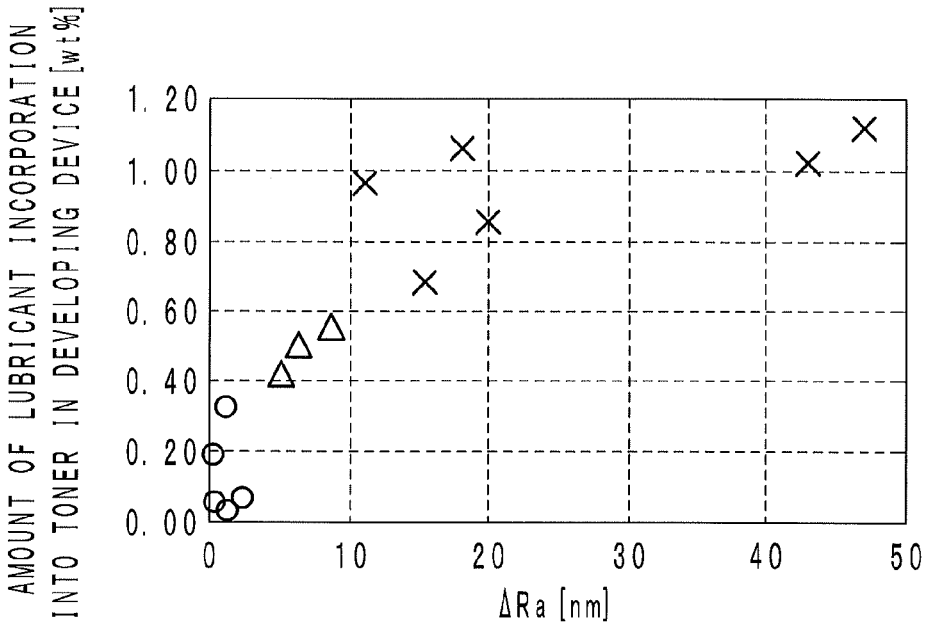
FIG. 8 is a graph plotting the amount of lubricant incorporation with respect to the difference values ΔRa in FIG. 7.

FIG. 8 is a graph plotting the relationship between the amount of lubricant incorporation into the developing device 24 and image fogging with respect to the difference values ΔRa shown in FIG. 7. Circles, triangles, and crosses in FIG. 8 are as defined above. More specifically, circles indicate no image fogging, triangles indicate slight image fogging, and crosses indicate image fogging. It can be appreciated from FIG. 8 that no serious image fogging occurs so long as the difference value ΔRa falls within a range that satisfies the relationship ΔRa<10 nm. It can also be appreciated that even slight image fogging does not occur, in particular, where ΔRa<5 nm.

Figure 9:
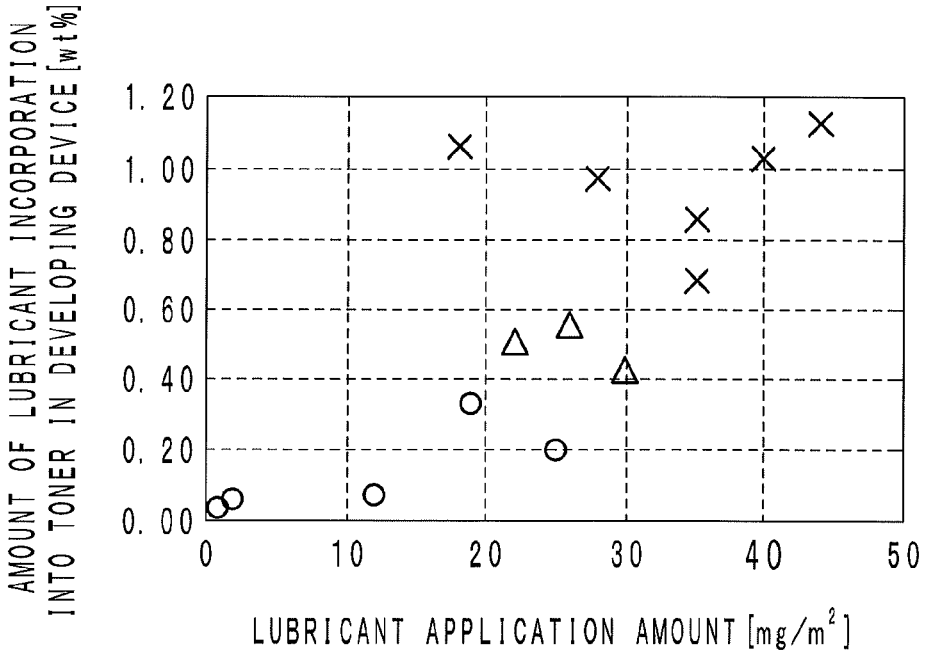
FIG. 9 is a graph plotting the amount of lubricant incorporation with respect to the amounts of lubricant application in FIG. 7.

FIG. 9 is a graph plotting the relationship between the amount of lubricant incorporation into the developing device 24 and image fogging with respect to the amounts of lubricant application shown in FIG. 7. Circles, triangles, and crosses in FIG. 9 are defined the same as in FIG. 8. It can be appreciated from FIG. 9 that there is no particular correlation between the amount of lubricant application and the amount of lubricant incorporation.

As can be appreciated by comparing FIGS. 8 and 9, the amount of lubricant incorporation into the developing device 24 (image fogging) is correlated with the difference value ΔRa. In other words, by setting the conditions for lubricant application by the application brush 522 on the basis of the difference value ΔRa, it is rendered possible to suppress the amount of lubricant incorporation into the developing device 24 and also occurrence of image fogging, thereby preventing image quality reduction to a certain degree.

Furthermore, by setting the conditions for lubricant application by the application brush 522 such that, in particular, ΔRa <10 nm, image quality reduction can be prevented to a greater degree, as is apparent from the foregoing. Moreover, it is further preferable that ΔRa<5 nm because image fogging can be essentially suppressed.

The above application conditions based on the difference value ΔRa are described in advance, for example, in a program stored in the control unit 5. The control unit 5 follows the program to set the lubricant application conditions such that the amount of lubricant application decreases if ΔRa is greater than a predetermined range or the amount of lubricant application increases if ΔRa is less than the predetermined range. To decrease or increase the amount of lubricant application, adjustments are made such that the rotational speed of the application brush 522 becomes lower or higher, the biasing force of the biasing unit 55 becomes lower or higher, and the difference between the surface potential of the photoreceptor drum 21 and the bias potential applied to the application brush 522 becomes greater or smaller.

Figure 10:
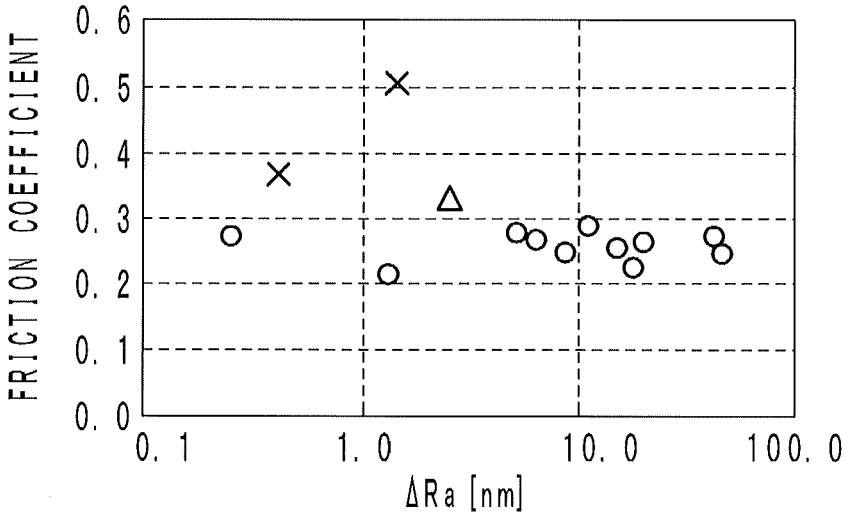
FIG. 10 is a graph plotting the friction coefficient of the surface of the photoreceptor drum 21 with respect to the difference values ΔRa in FIG. 7.

FIG. 10 is a graph plotting the friction coefficient of the surface of the photoreceptor drum 21 with respect to the difference values ΔRa shown in FIG. 7. In FIG. 10, circles represent good cleanability, triangles represent moderately good cleanability, and crosses represent poor cleanability. It can be appreciated from FIG. 10 that cleanability is not significantly correlated with the difference value ΔRa. Looking at, for example, each of the variables 7 to 9 in FIG. 7, the difference value ΔRa is low and less than 5 nm, but the amount of lubricant application itself is less than 15 $mg/m^2$, which is extremely low. Therefore, it can be conceived that a sufficient lubricant film is not formed on the surface of the photoreceptor drum 21, resulting in poor cleanability or only moderately good cleanability. However, both image quality and cleanability can be good if the difference value ΔRa is less than 10 nm under the conditions that the amount of lubricant application is 15 $mg/m^2$ or more and an appropriate lubricant film is formed. Therefore, it is more preferable to consider the amount of lubricant application as a condition for lubricant application, in addition to the difference value ΔRa.

Although the present invention has been described in connection with the preferred embodiment above, it is to be noted that various changes and modifications are possible to those who are skilled in the art. Such changes and modifications are to be understood as being within the scope of the invention.

What is claimed is:

1. A method applicable to an image forming apparatus with a lubricant to be applied to a surface of a photoreceptor for measuring surface roughness of the surface of the photoreceptor after lubricant application, the method comprising:

a first step of measuring a surface profile of the photoreceptor and obtaining first data indicating the surface profile;

a second step of generating second data on the basis of the first data, the second data indicating arithmetic mean roughness Ra within a predetermined range; and a third step of calculating a difference value ΔRa between second data before lubricant application and second data after lubricant application obtained by performing the first and second steps both before and after the lubricant is applied to the photoreceptor.

2. The method according to claim 1, wherein the second data after lubricant application represents arithmetic mean roughness Ra for the surface of the photoreceptor induced by lubricant particles adhering to the surface.

3. The method according to claim 1, further comprising:

a fourth step to be performed after the first step to perform Fourier transform on the first data, thereby generating third data representing the surface profile of the photoreceptor on a wavelength axis;

a fifth step of filtering out a wavelength component specific to surface roughness of a base of the photoreceptor from the third data, thereby generating fourth data; and a sixth step of performing inverse Fourier transform on the fourth data, thereby generating fifth data representing the surface profile of the photoreceptor free of the wavelength component, wherein, the second step generates the second data from the fifth data.

4. The method according to claim 1, wherein in the first step, the surface profile of the photoreceptor is measured by a surface roughness profiler employing optical interferometry.

5. The method according to claim 3, further comprising a seventh step of removing the lubricant from the surfaces of the photoreceptor at a preset time, wherein, the first and second steps are performed after the seventh step, thereby obtaining fifth data before lubricant application.

6. An image forming apparatus for which a condition for lubricant application to a photoreceptor is set utilizing the difference value ΔRa obtained by the method of claim 1.

7. The image forming apparatus according to claim 6, comprising:

a photoreceptor;

a lubricant; and an application brush configured to be able to contact the lubricant and the photoreceptor and configured to rotate to scrape and supply the lubricant to a surface of the photoreceptor, wherein, a rotational speed of the application brush is set on the basis of the difference value ΔRa as a condition for lubricant application to the photoreceptor.

8. The image forming apparatus according to claim 6, comprising:

a photoreceptor;

a lubricant; and an application brush configured to be able to contact the lubricant and the photoreceptor and configured to rotate to scrape and supply the lubricant to a surface of the photoreceptor, wherein, a difference between a surface potential of the photoreceptor and a bias potential applied to the application brush is set on the basis of the difference value ΔRa as a condition for lubricant application to the photoreceptor.

9. The image forming apparatus according to claim 6, wherein the difference value ΔRa satisfies the relationship $\Delta Ra < 10$ nm.

* * * * *